US009133725B2

(12) United States Patent
Wiebe

(10) Patent No.: US 9,133,725 B2
(45) Date of Patent: Sep. 15, 2015

(54) AXIAL SHAFT SEAL FOR A TURBOMACHINE

(75) Inventor: Frank Wiebe, Dormagen-Gohr (DE)

(73) Assignee: ATLAS COPCO ENERGAS GMBH, Cologne (DE)

( * ) Notice: Subject to any disclaimer, the term of this patent is extended or adjusted under 35 U.S.C. 154(b) by 539 days.

(21) Appl. No.: 13/471,520

(22) Filed: May 15, 2012

(65) Prior Publication Data

US 2013/0011245 A1 Jan. 10, 2013

(30) Foreign Application Priority Data

Jul. 7, 2011 (DE) ..... 10 2011 051 650

(51) Int. Cl.
*F01D 11/02* (2006.01)

(52) U.S. Cl.
CPC ..... *F01D 11/02* (2013.01)

(58) Field of Classification Search
CPC ..... F01D 11/00; F01D 11/02; F01D 11/04; F04D 29/08; F04D 29/104; F04D 29/2266
USPC ..... 415/173.1, 174.2, 174.5
See application file for complete search history.

(56) References Cited

U.S. PATENT DOCUMENTS 3,895,689 A * 7/1975 Swearingen ..... 184/6.4
3,966,351 A * 6/1976 Sproule ..... 415/110
4,472,107 A * 9/1984 Chang et al. ..... 415/104
4,502,697 A * 3/1985 Heinl ..... 277/374
5,248,239 A * 9/1993 Andrews ..... 415/104
5,297,928 A * 3/1994 Imakiire et al. ..... 415/112
5,688,105 A * 11/1997 Hoffelner ..... 415/170.1
6,010,132 A * 1/2000 Bagepalli et al. ..... 277/355
6,616,423 B2 9/2003 Bosen
7,252,474 B2 * 8/2007 Belokon et al. ..... 415/1
8,113,798 B2 2/2012 Bosen
2008/0095610 A1 * 4/2008 Bosen ..... 415/104
2010/0322781 A1 * 12/2010 Heyes et al. ..... 416/244 A

FOREIGN PATENT DOCUMENTS

DE 102004041439 A 3/2006

* cited by examiner

*Primary Examiner* — Dwayne J White
*Assistant Examiner* — William Grigos
(74) *Attorney, Agent, or Firm* — Andrew Wilford

(57) ABSTRACT

A turbomachine has a housing having a passage extending along an axis and an annular axially directed housing face extending radially from the passage. A shaft extending axially in the passage has an outer shaft surface radially spaced from an inner surface of the passage and forming therewith an annular axially extending gap. A radial impeller fixed to the shaft outside the housing has an axially directed and radially extending impeller face axially spaced from and confronting the radial housing face and forming therewith a radially extending gap opening into the axially extending gap. An impeller housing forms a flow space with the impeller outside the housing. The radial gap opens into the flow space. A plurality of spaced seals engaged in the radial gap between the radial faces of the housing and impeller fluidically separates the axial gap from the flow space.

7 Claims, 2 Drawing Sheets

AXIAL SHAFT SEAL FOR A TURBOMACHINE

FIELD OF THE INVENTION

The present invention relates to an axial shaft seal. More particularly this invention concerns such a seal for a turbomachine.

BACKGROUND OF THE INVENTION

A standard turbomachine has a rotor shaft mounted in a housing, at least one radial impeller arranged on an end of the rotor shaft in a respective impeller housing and having a seal assembly between a flow region of the impeller housing and a free space surrounding the rotor shaft inside the housing. The seal assembly in turn has a plurality of seals spaced apart from one another in order to separate the flow region from the free space. The radial impeller serves to expand or compress a fluid so that the flow regions inside the impeller housing, in particular a flow region radially adjacent the impeller, are at a pressure different from that of the rotor shaft inside the free space surrounding the housing, typically higher.

In order to avoid unwanted fluid flow through the housing and to avoid pressure losses that reduce the efficiency of the turbomachine, a seal assembly on an axially extending part of the shaft is usually provided between the flow regions of the impeller housing on the one hand and the free space inside the housing on the other. From practical experience it is also known to arrange seals in the form of brush seals, slip ring seals or labyrinth seals between the rotor shaft and housing on an axially extending part of the shaft. To make this possible, the rotor shaft must have a sufficient length inside the housing. Furthermore, bearings and optionally an electrical machine in the form of a motor or a generator must be provided in the housing. Accommodating all this structure—electric machine, bearings, seals—on the shaft requires it to be quite long.

A turbomachine that has a circumferential brush seal in a radial gap between the back of a radial impeller and an associated housing surface for expanding or compressing a fluid in the form of a gas or vapor is disclosed in DE 10 2004 041 439. In an embodiment with the characteristics described in the introduction, according to which the seal assembly has a plurality of seals that are spaced apart from one another, in addition to the circumferential brush seal, a labyrinth seal is provided on an axially extending shaft part so that a flow region laterally adjacent to the radial impeller is separated from the free space surrounding the rotor shaft inside the housing by the brush seal in the radial gap and by the labyrinth seal on the axially extending part of the shaft.

Turbomachines provided on the rear face of the radial impeller with a fluid chamber that can be pressurized with a compressed fluid in order to compensate for axial thrust forces are disclosed in EP 1 281 836 [U.S. Pat. No. 6,616,423] and DE 10 2006 049 516 [U.S. Pat. No. 8,113,798]. The supporting forces from the intermediate space as a buffer can be varied by feeding in and pumping out the compressed fluid. A seal assembly between the rear of the radial impeller and the housing on the one hand and an axially extending part of the rotor shaft on the other is necessary in order to define this intermediate space.

Due to the high rotational speeds, the problem frequently arises when operating turbomachines that the natural frequency of the components, in particular of the rotor assembly, must be taken into account. When the operating frequency in the turbomachine lies in the region of critical natural frequencies, there is a risk of increased vibration that can lead to increased wear or even to damage to the turbomachine. It is therefore known to avoid the regions of specific natural frequencies when operating a turbomachine.

OBJECTS OF THE INVENTION

It is therefore an object of the present invention to provide an improved turbomachine.

Another object is the provision of an improved shaft seal for a turbomachine that overcomes the above-given disadvantages, in particular that avoids or at least reduces the above-described disadvantages.

SUMMARY OF THE INVENTION

A turbomachine has according to the invention a housing having a passage extending along an axis and an annular axially directed housing face extending radially from the passage. A shaft extending axially in the passage has an outer shaft surface radially spaced from an inner surface of the passage and forming therewith an annular axially extending gap. A radial impeller fixed to the shaft outside the housing has an axially directed and radially extending impeller face axially spaced from and confronting the radial housing face and forming therewith a radially extending gap opening into the axially extending gap. An impeller housing forms a flow space with the impeller outside the housing. The radial gap opens into the flow space. A plurality of spaced seals engaged in the radial gap between the radial faces of the housing and impeller fluidically separates the axial gap from the flow space. The axially extending outer surface of the shaft and inner surface of the passage is free of seals.

Thus the entire seal assembly with its seals for maintaining the pressure differential between the radial flow region and the axial space is provided in the radially extending gap and an axially extending section of the rotor shaft is free of seals. Accordingly, the shaft does not have to be long enough to accommodate a seal, enabling the rotor shaft to be made correspondingly shorter. The dynamic rotational behavior of the rotor is significantly improved even though the saving in material and space is relatively small. By shortening the axial installation space of the rotor shaft, the whole rotor becomes stiffer, as a result of which the specific natural vibration frequencies are increased. Accordingly, when operating the turbomachine, the specific natural frequencies are only reached at extremely high speeds, even when they cannot actually be shifted above the maximum speed.

The turbomachine can have just one radial impeller on the rotor shaft or a radial impeller on each end of the shaft. It is therefore within the scope of the invention to have a first radial impeller is on a first shaft end in a first impeller housing and a second radial impeller on a second shaft end in a second impeller housing, with a seal assembly having the previously described characteristics in a radial gap between a flow region of the first impeller housing and the free space on the one hand and a flow region of the second impeller housing and the free space on the other. The seal assembly has at least two seals that are arranged in the respective radially extending gap at a radial spacing from one another.

Within the scope of the invention, the radial gap can also be formed by a plurality of gap sections that are offset axially from one another, thus resulting in a stepped shape. However, the individual seals are even then always arranged in the radially extending gap sections.

Within the scope of the invention, differentiation is made between the housing on the one hand and the impeller housing on the other. In so doing, it is within the scope of the invention when the housing and the impeller housing can be completely separated from one another. The housing and the impeller housing can, however, also be parts of a single housing, that is integral or even unitary with each other. In order to gain access to the individual components of the turbomachine, such a single housing can be separated along it axis into two parts, for example a top part and a bottom part.

If the turbomachine only has one cantilevered radial impeller arranged on the rotor shaft, a gearbox or an electrical machine is usually provided in the housing as an input unit when operating as a compressor or as an output unit when operating as an expander. If, in an embodiment with two cantilevered radial impellers, the turbomachine is intended as a two-stage compressor or two-stage expander, here too a gearbox or an electrical machine, i.e. a motor or a generator, is necessary as an input unit or as an output unit. In a combined compander, i.e. when one radial impeller is provided for expansion and the other radial impeller for compression, the compressor stage can be driven directly from the expansion stage. However, a gearbox or an electrical machine can also be provided here to exploit excess energy or to feed in needed energy.

According to a preferred embodiment of the invention, the seal assembly with the plurality of seals that are spaced apart from one another is provided on a back face of the radial impeller that is directed toward the housing, while the front of the radial impeller is provided with blades for compressing or expanding the process fluid.

Depending on the process fluid, it may be necessary to protect the fluid against contamination or to prevent leakage losses escaping from the process fluid into the housing. In order to flush the region of the seal assembly or to discharge a leakage gas, a connecting opening for feeding in a blocking gas or for discharging the leakage gas can be provided in at least one intermediate chamber formed between the seals. This intermediate chamber also extends at least in sections along the gap in a radial direction. The connecting opening can be formed by a hole in the housing, for example, to which a feed or discharge pipe leading to a pump is connected.

Within the scope of the invention, brush seals, slip ring seals and alternately arranged projections in the gap that form a labyrinth are suitable as seals of the seal assembly. Identical seals or different types of seals can be used to form a seal assembly. In the case of brush seals and slip ring seals, the sealing surfaces that are associated with one another are advantageously aligned perpendicular to the axis of the rotor shaft.

BRIEF DESCRIPTION OF THE DRAWING

The above and other objects, features, and advantages will become more readily apparent from the following description, reference being made to the accompanying drawing in which.

DETAILED DESCRIPTION

Figure 1:
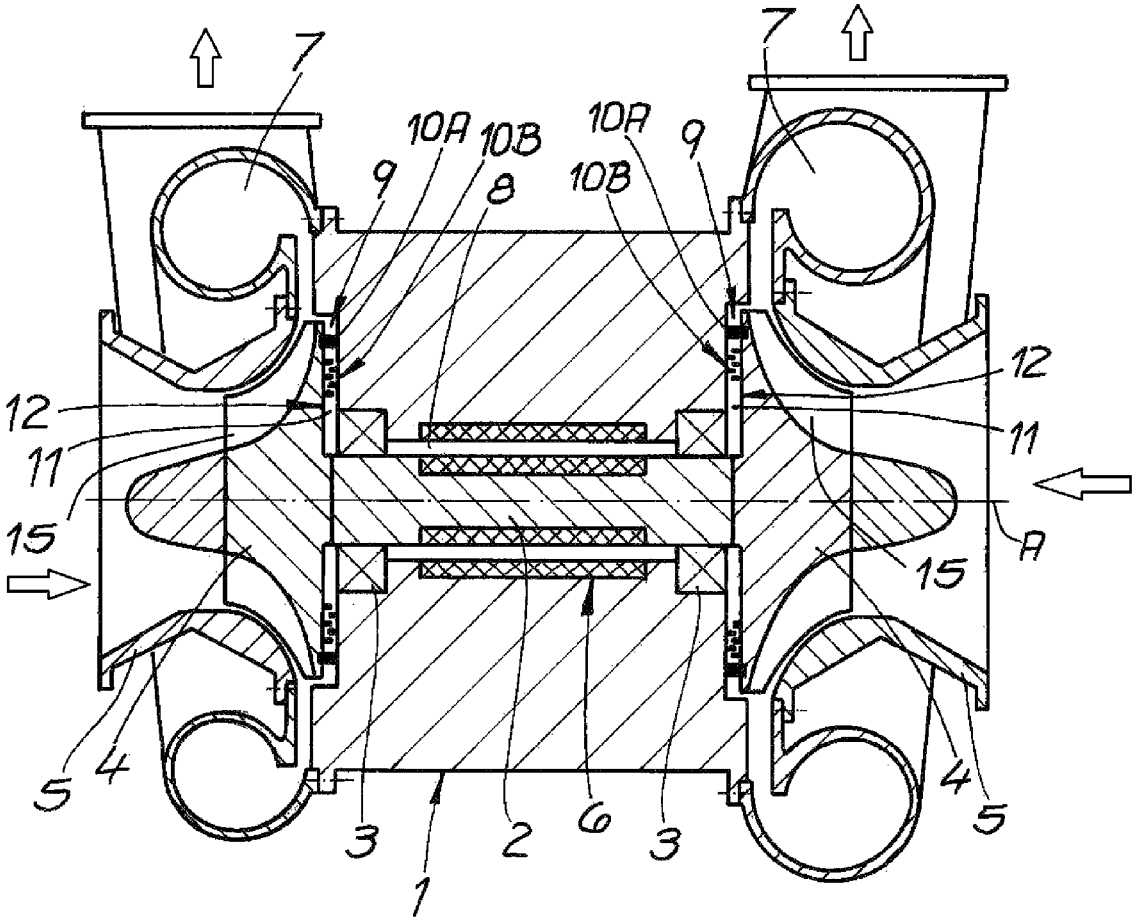
FIG. 1 is an axial section through a turbomachine with an axial shaft seal.

As seen in FIG. 1 a turbomachine has a rotor shaft 2 extending along an axis A in a passage of a housing 1. Axial- and radial-thrust bearings 3 for the rotor shaft 2 can be roller bearings, magnetic bearings, hydrostatically lubricated bearings and/or hydrodynamically lubricated bearings. A cylindrical outer surface of the shaft 2 forms with a cylindrical inner surface of the housing 1 an annular and axially extending gap 8.

In the illustrated embodiment, a cantilevered radial impeller 4 is carried on each end of the rotor shaft 2 in a respective impeller housing 5 and forms therewith a respective flow region 7 through which a fluid, typically air, flows radially outward by axially outwardly and radially extending vanes 15 on the impellers 4. This air flow is either forced axially inward and expelled radially outward when the turbomachine is being operated as an expander or sucked axially inward and expelled radially outward when the turbomachine is operated as a compressor.

An electrical machine 6 is provided inside the housing 1 and on the rotor shaft 2 as an input or output device. When the two radial impellers 4 are operated as stages of a compressor, the rotor shaft 2 is driven by the electrical machine 6 serving as a motor. When the radial impellers 4, on the other hand, are stages of an expander, the electrical machine 6 operates as a generator. It is critical that the region of the gap 8 be kept clean to protect the bearings 3 and the machine 6. Typically the machine comprises coils in the housing 1 and magnets, preferably permanent, on the shaft 2.

According to the invention, seal assemblies 9 each having a plurality of seals 10A, 10B are provided for the fluidic separation of the flow regions 7 formed between the impeller housings 5 and the impellers 4 and the gap or free space 8 surrounding the rotor shaft 2 inside the housing 1. According to the invention, the entire seal assembly 9 that maintains a pressure differential between the flow region 7 that normally is at superatmospheric pressure and the free space 8 that is at atmospheric pressure. The seal assemblies 9 with their seals 10A, 10B are mounted in respective radially extending gaps 11 formed between a planar back face of the respective impeller 4 and a confronting axial end face of the housing 1. As a result, axially extending sections of the rotor shaft 2 are free of seals. Compared with the designs known from the prior art, the rotor shaft 2 can therefore be made comparatively short, as a result of which the whole rotor is dynamically stiff and has high specific natural frequencies.

For the seals 10A, 10B in the embodiment of FIG. 1, the first seals 10A are annular slip ring seals basically comprising a ring carried on the rotor back face and sliding on the housing end face. The second seals 10*b* are a plurality of projections forming a labyrinth on back faces 12 of the two radial impellers 4, that is two short concentric cylindrical rings fixed on the housing end face and two short concentric rings fixed on the rotor back face and interleaved with the housing rings.

Figure 2:
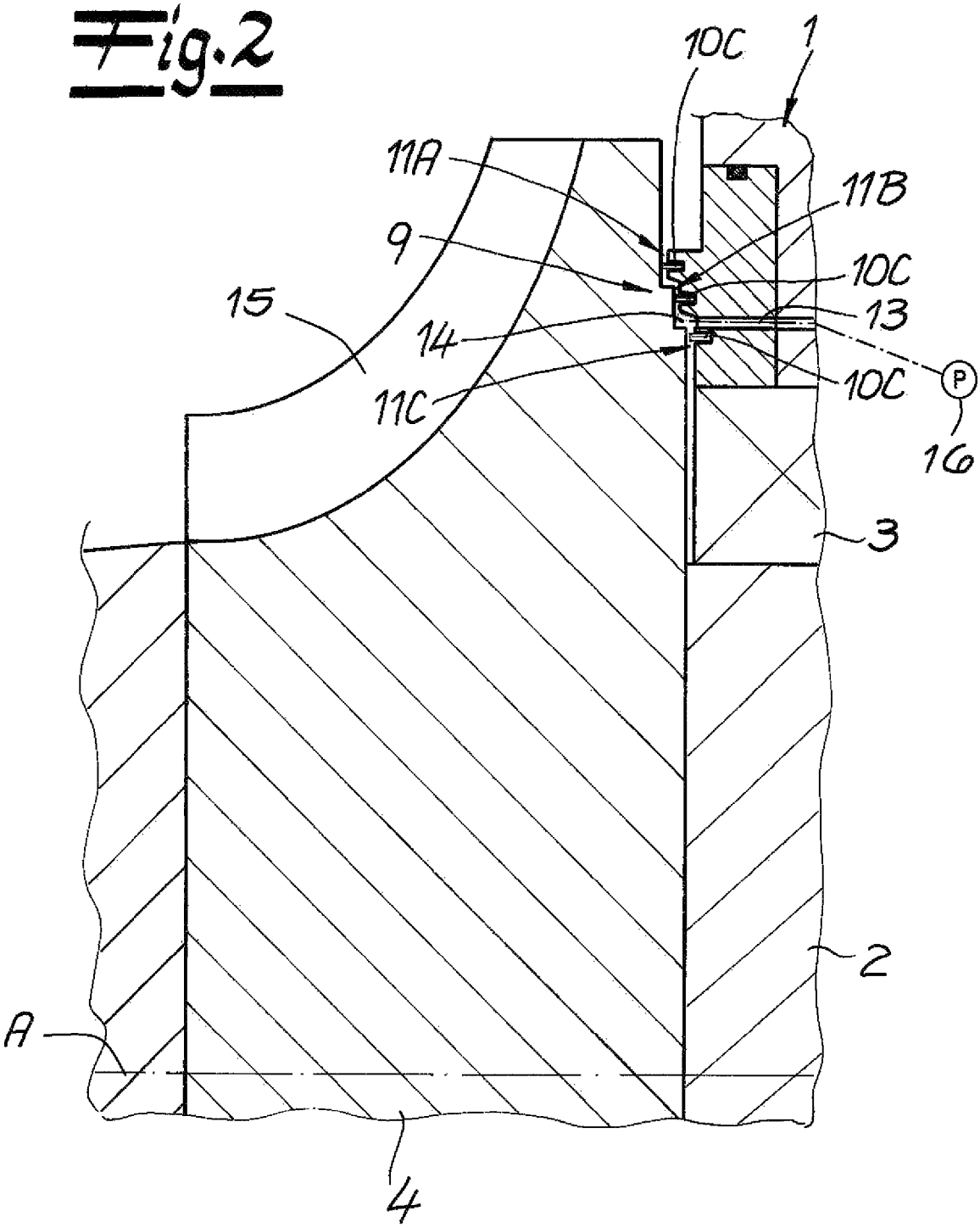
FIG. 2 is a large scale view of detail of another shaft seal for a turbomachine.

FIG. 2 is a detailed view of an alternative design of a turbomachine according to the invention, where the radial gap 11 is divided into complementary steps 11A, 11B and 11C formed in the confronting housing and impeller faces. A seal 10C, which in the illustrated embodiment is for example a brush seal formed by a circular brush with axially extending bristles, is arranged in each radial gap section 11A, 11B, 11C. In order to be able to feed a blocking gas to the seal assembly 9 or to be able to discharge a leakage gas from the seal assembly 9, a hole 13 opens radially outwardly out into an intermediate chamber 14 between two seals 10C spaced from one another. This hole 13 is connected to a pump 16 that can either force a gas into the space 14 between the two inner seals 10C and 11C or pump out gas from this space 14. Thus this space 14 is always a pressure above or below atmospheric to eliminate the possibility of flow from the regions 7 into the region 8.

I claim:

1. A turbomachine comprising:

a main housing having a housing passage extending along an axis and annular axially outwardly directed housing faces extending radially from ends of the housing passage;

a shaft extending axially in the housing passage, having ends projecting axially past the housing faces, and having an outer shaft surface radially spaced from an inner surface of the housing passage and forming therewith an annular axially extending gap open at the housing faces;

a respective radial impeller fixed to each end of the shaft outside the main housing and having an axially directed and radially extending impeller face axially spaced from and confronting the respective radial housing face and forming therewith a respective radially extending gap opening into the axially extending gap at the respective end of the housing passage;

respective impeller housings forming respective flow spaces with the impellers outside the main housing, the radial gaps opening into the respective flow spaces;

respective pluralities of spaced brush or slide seals engaged in the radial gaps between the respective radial faces of the main housing and impeller, defining therein a respective annular space, having faces extending perpendicular to the axis, fluidically separating the axial gap from the respective flow space, and preventing fluid flow through the housing passage and efficiency-reducing pressure losses, the axially extending outer surface of the shaft and inner surface of the passage being free of seals, the main housing being formed with a pump passage opening into the annular space between the seals; and means connected to the pump passage for feeding a blocking gas into the annular space or extracting a leakage gas from the annular space.

2. The turbomachine defined in claim 1, further comprising:

an electrical machine on the shaft and in the housing.

3. The turbomachine defined in claim 1, wherein the means for feeding a gas includes a pump.

4. The turbomachine defined in claim 1, wherein the seals alternate on the respective radial faces and form a labyrinth.

5. The turbomachine defined in claim 1, wherein the impellers each have axially projecting and radially extending vanes in respective the flow space.

6. The turbomachine defined in claim 1, wherein the axial back face of each of the impellers and the respective axial end face of the housing forming the respective radial gap therewith are both complementarily formed with at least two interfitting steps each having an axially directed annular surface carrying a respective one of the seals.

7. The turbomachine defined in claim 1, wherein each of the seals extends axially from a respective one of the radial faces and axially engages the radial face confronting the respective one radial face.

* * * * *